US006828495B2

(12) United States Patent
Ishimatsu

(10) Patent No.: US 6,828,495 B2
(45) Date of Patent: Dec. 7, 2004

(54) DRUM AND DRUMHEAD STRETCHING MECHANISM THEREFOR

(75) Inventor: Norihiko Ishimatsu, Hamamatsu (JP)

(73) Assignee: Yamaha Corporation (JP)

( * ) Notice: Subject to any disclaimer, the term of this patent is extended or adjusted under 35 U.S.C. 154(b) by 59 days.

(21) Appl. No.: 10/419,806

(22) Filed: Apr. 22, 2003

(65) Prior Publication Data

US 2003/0230185 A1 Dec. 18, 2003

(30) Foreign Application Priority Data

Apr. 26, 2002 (JP) ..... 2002-126485
Apr. 2, 2003 (JP) ..... 2003-098855

(51) Int. Cl.[7] ..... G10D 13/02
(52) U.S. Cl. ..... 84/413; 84/411 R; 84/411 A
(58) Field of Search ..... 84/413, 411 R, 84/411 A

(56) References Cited

U.S. PATENT DOCUMENTS 1,039,834 A * 10/1912 Soistmann ..... 84/411 R
3,139,783 A * 7/1964 Grant et al. ..... 84/411 R
4,122,747 A * 10/1978 Yamashita, Toshinori . 84/411 R

FOREIGN PATENT DOCUMENTS

| | | |
|---|---|---|
| JP | 59-1263 | 1/1984 |
| JP | 63-128595 | 8/1988 |
| JP | 1-171498 | 12/1989 |
| JP | 4-98093 | 8/1992 |

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

In a drumhead stretching mechanism adapted to a drum, a bolt for tightening or loosening a drumhead stretched at ends of a hollow cylinder under tension is inserted into a latch that is hooked on a clamp frame for clamping and holding outer circumferential ends of the drumhead, wherein a hollow space is formed inside of the latch to store an anti-extraction member having a U-shape, which is engaged with the bolt. Alternatively, the latch and anti-extraction member can be integrally interconnected together. Thus, it is possible to reliably prevent the bolt from being extracted, from unnecessarily rotating, and from floating in the axial direction of the bolt even when the bolt is taken out from a lug nut, which normally engages with the tip end portion of the bolt.

9 Claims, 6 Drawing Sheets

DRUM AND DRUMHEAD STRETCHING MECHANISM THEREFOR

BACKGROUND OF THE INVENTION

1. Field of the Invention

This invention relates to drums such as bass drums, and particularly relates to drumhead stretching mechanisms for stretching drumheads under tension.

2. Description of the Related Art

Drums such as bass drums and snare drums are made of hollow cylinders covered at ends with stretched skins called drumheads, which are supported and fixed by prescribed mechanisms applying tensions thereto. For example, there are provided two types of mechanisms, i.e., a first mechanism in which a clamp frame and lug nuts are directly interconnected using bolts (as disclosed in Japanese Examined Utility-Model Publication No. Sho 59-1263) and a second mechanism in which bolts and a clamp frame are interconnected via latches. In particular, the second mechanism using latches may be frequently used for bass drums having relatively large diameters.

FIG. 9 shows a conventional example of a drumhead stretching mechanism using latches, wherein reference numeral 1 designates a part of a cylindrical wall of a hollow cylinder (or a drum body), both ends of which are open, 2 designates a drumhead stretched over an opening of the hollow cylinder 1 under tension, and 3 designates a drumhead stretching mechanism.

The drumhead stretching mechanism 3 is constituted by various members, i.e., a ring head frame 4 that holds outer circumferential ends 2*a* of the drumhead 2 and is equipped with the outer circumference of the hollow cylinder 1, a ring clamp frame (or rim) 5 that is equipped with the outer circumference of the hollow cylinder 1 to press the ring head frame 4, a plurality of lugs 6 that are fixed on the outer circumference of the hollow cylinder 1, lug nuts 8 that are incorporated in the lugs 6 and are pressed upwardly by compression coil springs 7, bolts 9 that are engaged with the lug nuts 8, and latches 10 that interconnect together the bolts 9 and the ring clamp frame 5.

The bolt 9 has a head 9B and an external thread portion 9A, a part of which engages with a stopper 11 that is arranged to prevent the bolt 9 from being dropped from the latch 10 when the bolt 9 is taken off from the lug nut 8 and is directed downwards. That is, the stopper 11 is arranged downwardly apart from the latch 10 by an appropriate distance D in order to allow vertical movement of the bolt 9 in a tension adjustment mode of the drumhead 2.

In the drumhead stretching mechanism 3 having the aforementioned structure, when in a tension adjustment mode of the drumhead 2, the bolt 9 is tightened upon rotation using a tuning key (not shown), the distance between the latch 10 and the lug nut 8 is reduced, so that the clamp frame 5 presses the ring head frame 4 to increase tension applied to the drumhead 2. In contrast, when the bolt 9 is loosened, the pressure of the latch 10 applied to the clamp frame 5 is reduced, so that the pressure of the clamp frame 5 applied to the ring head frame 4 is reduced as well, thus reducing the tension of the drumhead 2.

The aforementioned drumhead stretching mechanism 3 is constituted in such a way that the stopper 11 made of a cylindrical nut is arranged to engage with the external thread portion 9A of the bolt 9; therefore, when the external thread portion 9A is relatively long, a human operator (or a user) should rotate and move the stopper 11 multiple times to be arranged in proximity to the latch 10. That is, the human operator is required to perform a troublesome operation in manipulating the stopper 11, which takes a relatively long time.

In the above, the bolt 9 can be taken off from the lug nut 8, wherein the bolt 9 can be freely moved in a vertical direction within a prescribed range of distance D measured from the lower end of the latch 10. Therefore, when the human operator holds and vertically reverses the bolt 9, the latch 10 may float or rattle within the distance D. When the human operator holds and vertically reverses the latch 10, the bolt 9 may float within the distance D.

In addition, the stopper 11 is merely attached to the bolt 9 and cannot prevent the bolt 9 from rotating by itself.

SUMMARY OF THE INVENTION

It is an object of the invention to provide a drum and a drumhead stretching mechanism in which a bolt for adjusting tension applied to a drumhead is arranged between a latch and a lug nut, wherein even when the bolt is taken off from the lug nut, it is possible to reliably prevent the bolt from being dropped from the latch, and it is possible to reliably prevent the bolt from unnecessarily rotating and from floating in an axial direction thereof.

In a drumhead stretching mechanism adapted to a drum in accordance with this invention, a bolt for tightening or loosening a drumhead stretched at ends of a hollow cylinder under tension is inserted into a latch that is hooked on a clamp frame for clamping and holding outer circumferential ends of the drumhead, wherein a hollow space for storing an anti-extraction member is formed inside of the latch, so that the shaft portion (specifically, non-thread portion) of the bolt is engaged with the anti-extraction member. The anti-extraction member substantially has a U-shape or a C-shape in plan view with a cutout opening communicating with an anti-extraction hole, into which the bolt is inserted and engaged in a direction perpendicular to the axial direction of the bolt. Thus, it is possible to reliably prevent the bolt from being extracted, from unnecessarily rotating, and from floating in the axial direction of the bolt even when the bolt is taken out from a lug nut, which normally engages with the tip end portion of the bolt.

In the above, the latch and the anti-extraction member can be integrally interconnected together, wherein the anti-extraction member has an anti-extraction hole having a rectangular shape whose short length is slightly less than the outer diameter of the bolt and whose long length is slightly larger than the outer diameter of the bolt.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENTS

This invention will be described in further detail by way of examples with reference to the accompanying drawings.

Figure 1A:
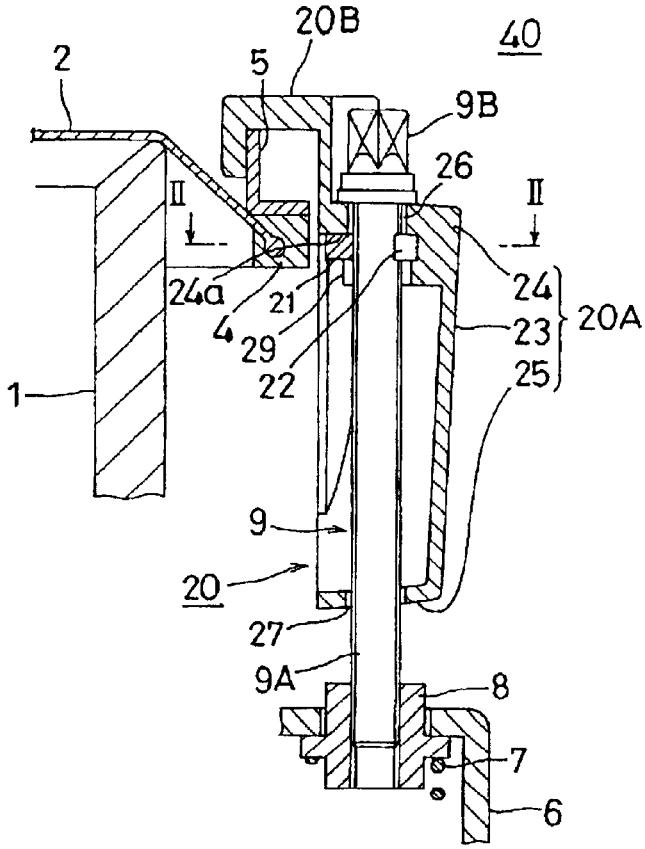
FIG. 1A is a cross sectional view showing the structure of a drumhead stretching mechanism mainly constituted by a head frame, a clamp frame, a latch, a bolt, and a lug nut in accordance with a preferred embodiment of the invention.
Figure 1B:
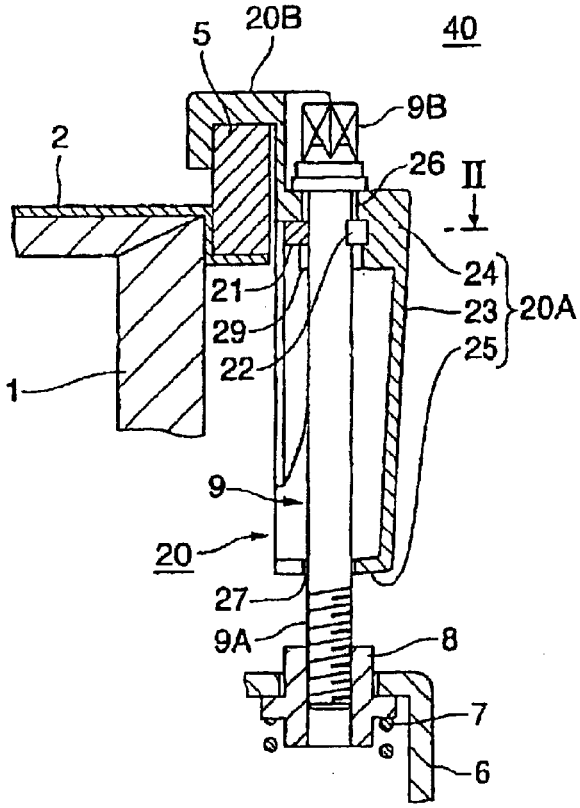
FIG. 1B is a cross sectional view showing the structure of the drumhead stretching mechanism in which outer circumferential ends of a drumhead are directly held by the clamp frame.

FIGS. 1A and 1B show essential parts of drumhead stretching mechanisms adapted to drums in accordance with a preferred embodiment of the invention, wherein FIG. 1A shows that outer circumferential ends of a drumhead are terminated by a head frame clamped by a clamp frame, while FIG. 1B shows that outer circumferential ends of a drumhead are integrally formed together with a head frame and are directly joined with a clamp frame.

Figure 2:
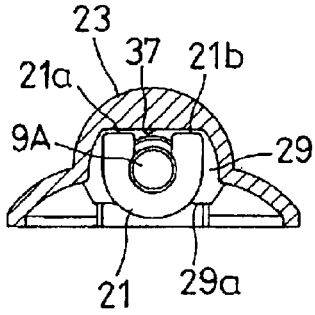
FIG. 2 is a cross sectional view taken along line II—II in FIGS. 1A and 1B.
Figure 3:
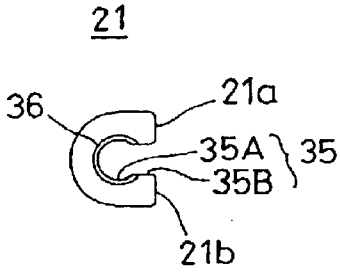
FIG. 3 is a plan view showing an anti-extraction member arranged in a main portion of the latch.
Figure 4:
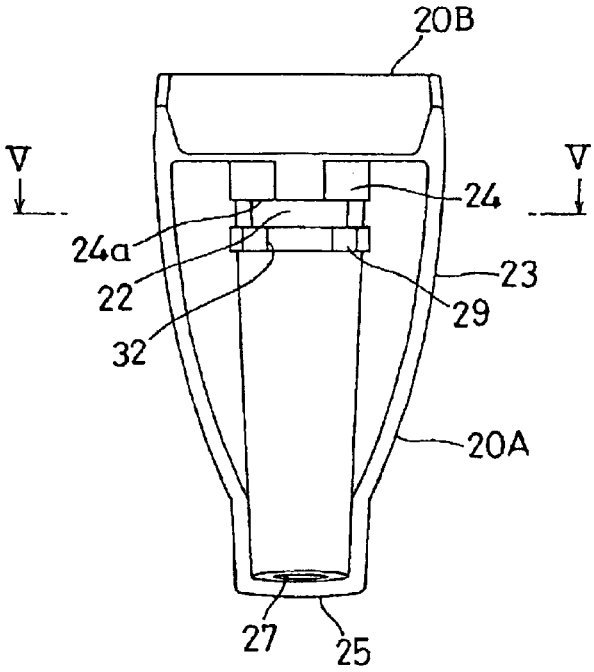
FIG. 4 is a rear view showing the latch constituted by a front board, an upper board, and a lower board.
Figure 5:
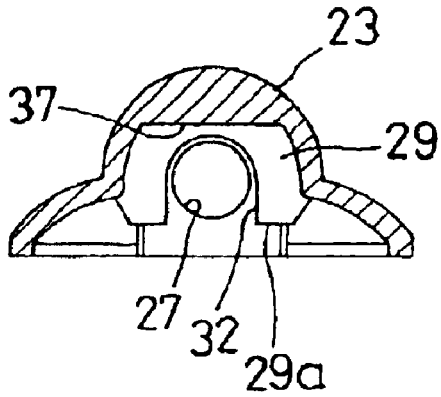
FIG. 5 is a cross sectional view taken along line V—V in FIG. 4.
Figure 6A:
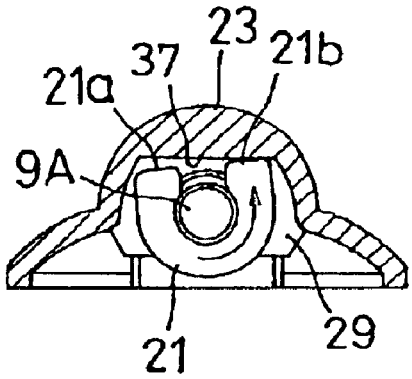
FIG. 6A is a cross sectional view showing the anti-extraction member that is securely stored the main portion of the latch and is stopped in further rotation in a counterclockwise direction.
Figure 6B:
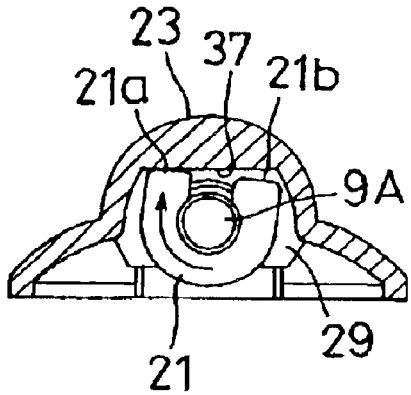
FIG. 6B is a cross sectional view showing the anti-extraction member that is stopped in further rotation in a clockwise direction.
Figure 9:
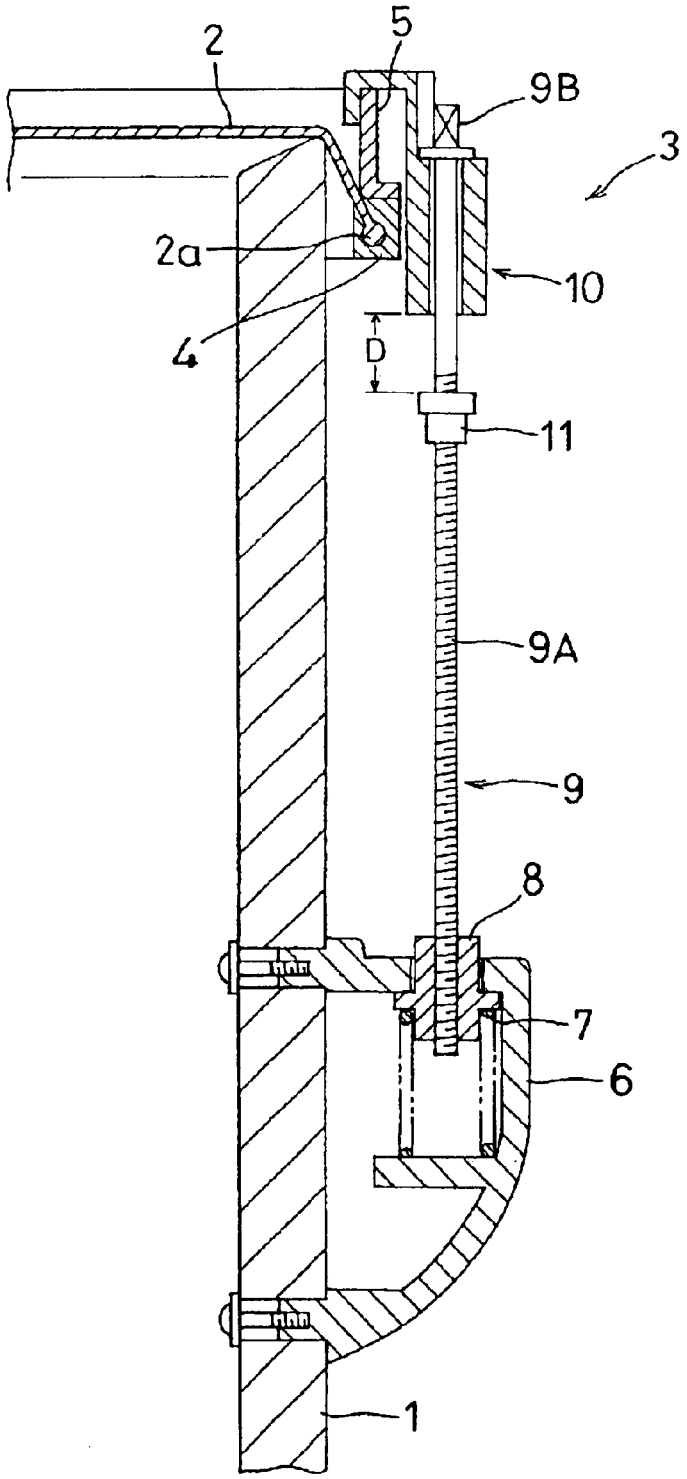
FIG. 9 (PRIOR ART)
FIG. 9 is a cross sectional view showing a conventional example of a drumhead stretching mechanism adapted to a drum.

FIG. 2 is a cross sectional view taken along line II—II in FIGS. 1A and 1B; FIG. 3 is a plan view showing an anti-extraction member; FIG. 4 is a rear view showing a latch; FIG. 5 is a cross sectional view taken along line V—V in FIG. 4; and FIGS. 6A and 6B show different conditions where an anti-rotation member comes in contact with the anti-extraction member. In the aforementioned figures, parts identical to those shown in FIG. 9 are designated by the same references numerals; hence, the description thereof will be omitted as necessary.

In a drumhead stretching mechanism 40 shown in each of FIGS. 1A and 1B, a latch 20 is arranged to interconnect together a clamp frame 5 and a bolt 9, wherein it is constituted by a main portion 20A through which a shaft portion (or an external thread portion) 9A of the bolt 9 penetrate, and a latch portion 20B that is integrally connected with and externally elongated from the upper end of the main portion 20A and is hooked on the upper end of the clamp frame 5. A hollow space 22 is formed at an upper position inside of the main portion 20A of the latch 20 in order to store an anti-extraction member 21 that engages with the shaft portion 9A of the bolt 9.

The main portion 20A of the latch 20 is constituted by a front board 23, an upper board 24, and a lower board 25, wherein the front board 23 has a specific horizontal cross section that is roughly a convex shape in a front side and is a concave shape in a rear side. The upper board 24 is integrally connected with the upper end of the front board 23, and the lower board 25 is integrally connected with the lower end of the front board 23. Through holes 26 and 27 allowing the shaft portion 9A of the bolt 9 to penetrate therethrough are formed at different positions of the main portion 20A of the latch 20, wherein they are formed roughly at centers of the upper board 24 and the lower board 25 respectively.

Compared with the lower board 25, the upper board 24 is made thick in order to secure a sufficient strength therefor. A bed portion 29 projects downwardly from a lower surface 24*a* of the upper board 24, wherein the aforementioned hollow space 22 for storing the anti-extraction member 21 is formed in a gap between the bed portion 29 and the lower surface 24*a* of the upper board 24. The bed portion 29 is arranged opposite to and substantially in parallel with the upper board 24. In addition, a U-shape channel 32 (see FIG. 5) allowing the shaft portion 9A of the bolt 9 to be inserted therethrough is formed roughly at the center of a backend surface 29*a* of the bed portion 29.

The latch portion 20B of the latch 20 formed like a reverse U-shape in side view (see FIG. 1B), so that it can be hooked on the clamp frame 5 in an axial direction of the hollow cylinder (i.e., drum body) 1.

As shown in FIG. 3, the anti-extraction member 21 is made of a prescribed material having an appropriate thickness such as a synthetic resin and a metal plate, and it is formed roughly in a U-shape in plan view. That is, the anti-extraction member 21 has a U-shape anti-extraction hole 35, which is constituted by a circular hole 35A and a linear hole 35B, wherein the one end of the linear hole 35B communicates with the circular hole 35A, and the other end is opened at terminal ends 21*a* and 21*b* of the anti-extraction member 21. The diameter of the circular hole 35A is approximately equal to the outer diameter of the shaft portion 9A of the bolt 9, and the width of the linear hole 35B is made slightly smaller than the outer diameter of the shaft portion 9A of the bolt 9 in order to prevent the bolt 9 from being extracted from the anti-extraction member 21.

The bolt 9 is sequentially inserted through the through holes 26 and 27 of the main portion 20A of the latch 20; and then, the bolt 9 is partially inserted into the hollow space 22 so that the shaft portion 9A is engaged with the anti-extraction member 21. In this case, the anti-extraction member 21 is put into the hollow space 22 from the rear side of the latch 20 in such a way that the terminal ends 21*a* and 21*b* of the anti-extraction member 21 are arranged opposite to and in proximity to a back wall 37 of the hollow space 22 (see FIG. 2). When the anti-extraction member 21 is inserted deeply into the hollow space 22, the linear hole 35B is slightly broadened by the shaft portion 9A of the bolt 9, which is then engaged with the circular hole 35A of the anti-extraction member 21. The anti-extraction member 21 having a U-shape may work like a C-shape snap ring, thus ensuring engagement with the bolt 9. That is, the anti-extraction member 21 adapted to the present embodiment can ensure one-touch insertion or engagement with a prescribed position of the bolt 9 without being rotated multiple times.

In addition, the back wall 37 of the hollow space 22, which is arranged opposite to and in proximity to the terminal ends 21*a* and 21*b* of the anti-extraction member 21, functions as an anti-rotation member for avoiding unnecessary rotation of the anti-extraction member 21.

Relationships between the anti-rotation member and the anti-extraction member 21 will be described in detail with reference to FIGS. 6A and 6B.

In FIG. 6A, when the bolt 9 is rotated to be loosened so that the drumhead 2 is to be reduced in tension, the anti-extraction member 21 rotate together with the bolt 9 in the same direction, wherein it slightly rotates in a counterclockwise direction so that the "right-side" terminal end 21*b* comes in contact with the back wall 37 of the hollow space 22, whereby the anti-extraction member 21 is stopped in further rotation. At this time, a frictional force between the wall of the circular hole 35A and the surface of the shaft portion 9A is increased to stop the bolt 9; therefore, it is possible to reliably prevent the bolt 9 from being unnecessarily loosened.

In FIG. 6B, when the bolt 9 is reversely rotated to be tightened so that the drumhead 2 is to be increased in tension, the anti-extraction member 21 rotate together with the bolt 9 in the same direction, wherein it slightly rotates in a clockwise direction so that the "left-side" terminal end 21 a comes in contact with the back wall 37 of the hollow space 22, whereby the anti-extraction member 21 is stopped in further rotation. At this time, a frictional force between the wall of the circular hole 35A and the surface of the shaft portion 9A is increased to stop the bolt 9; therefore, it is possible to reliably prevent the bolt 9 from being unnecessarily tightened.

In a drum equipped with the aforementioned drumhead stretching mechanism 40, even when the bolt 9 is taken off from the lug nut 8, it is possible to reliably prevent the bolt 9 from being unnecessarily rotated or from being extracted from the latch 20. In addition, even when the bolt is reversed in a vertical direction, it is possible to prevent the bolt 9 and the latch 20 from mutually floating with respect to each other. Furthermore, even when the bolt 9 is rotated, it is possible to prevent the bolt 9 from being loosened or tightened. That is, the anti-extraction member 21 for the present embodiment has three functions as follows:

(a) A first function to prevent the bolt 9 from being extracted from the latch 20.

(b) A second function to prevent the bolt 9 and the latch 20 from mutually floating with respect to each other in an axial direction even when the bolt 9 is taken off from the lug nut 8.

(c) A third function to prevent the bolt 9 from being unnecessarily loosened or tightened when rotated.

The aforementioned anti-extraction member 21 is simply engaged with the non-thread portion of the shaft portion 9A of the bolt 9 in a direction perpendicular to the axial direction of the bolt 9. Therefore, it is possible to attach the anti-extraction member 21 to and detach it from the bolt 9 rapidly with ease.

Figure 7A:
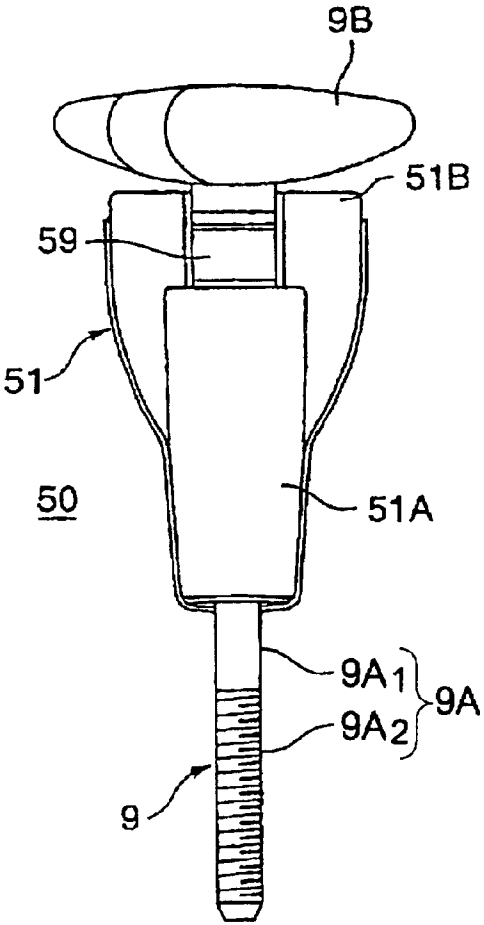
FIG. 7A is a front view showing an example of a latch that is modified compared with the latch shown in FIG. 4.
Figure 7B:
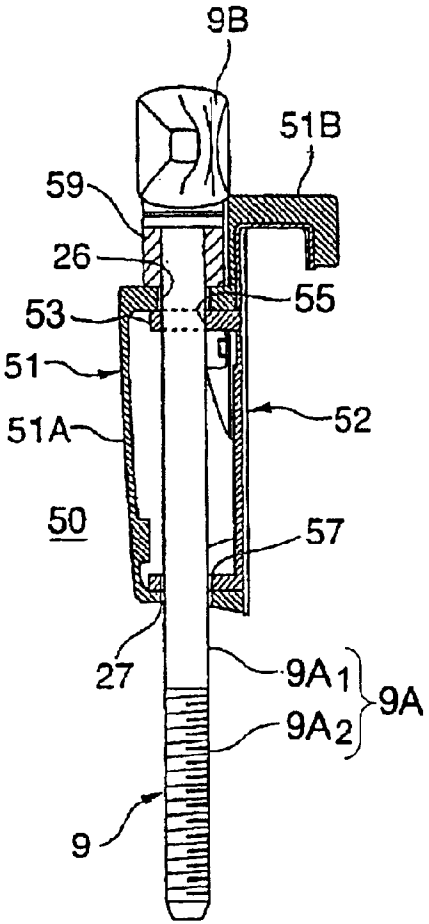
FIG. 7B is a cross sectional view of the latch shown in FIG. 7A.
Figure 7C:
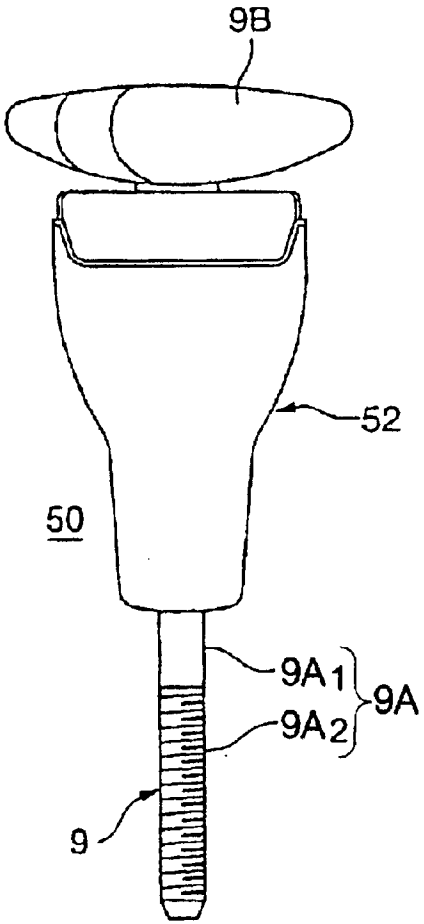
FIG. 7C is a rear view of the latch shown in FIG. 7A.
Figure 8:
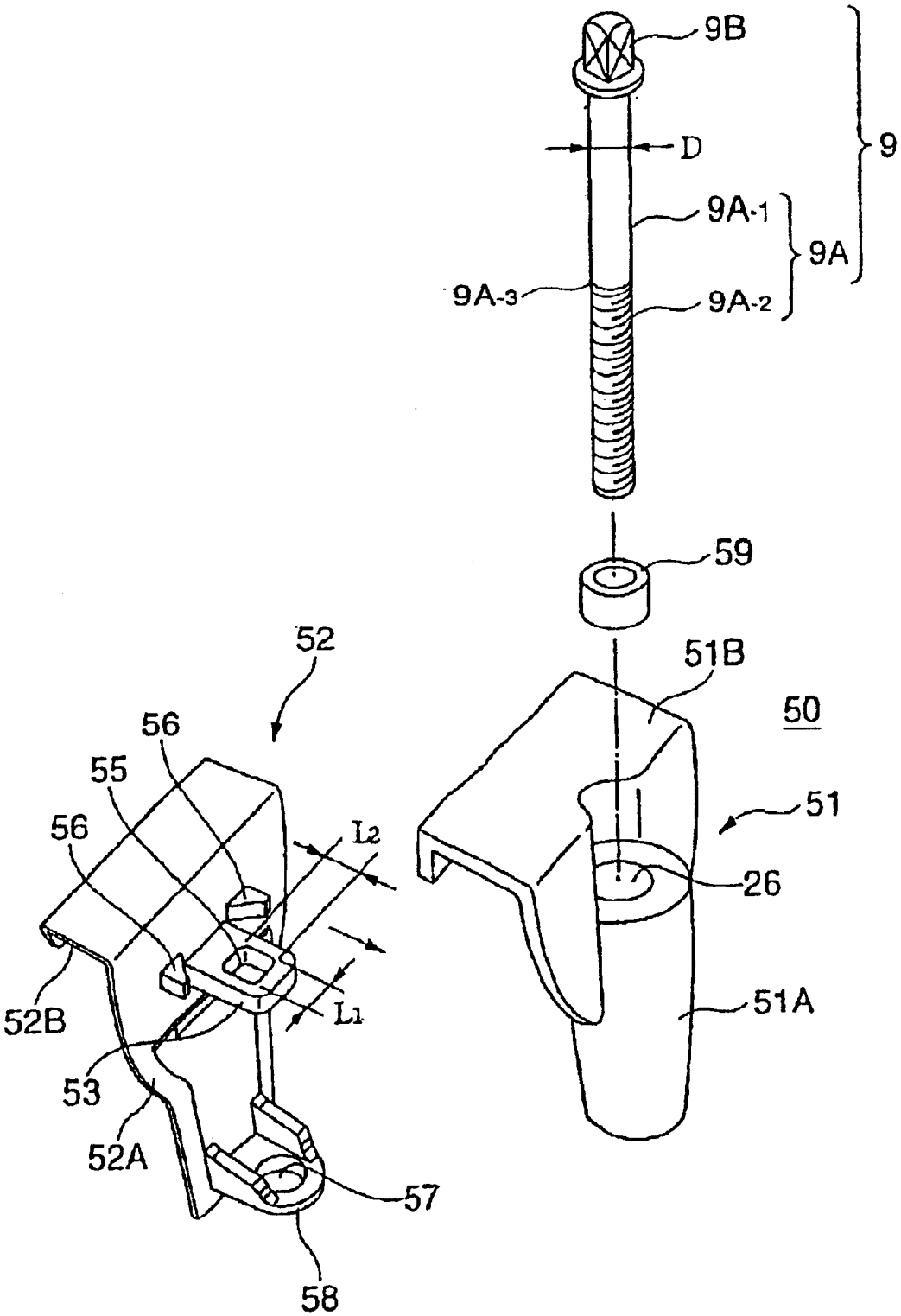
FIG. 8 is an exploded perspective view showing the latch and its related parts.

Next, a second embodiment will be described with reference to FIGS. 7A–7C and FIG. 8, wherein FIG. 7A is a front view of a latch 50, FIG. 7B is a cross sectional view of the latch 50, FIG. 7C is a rear view of the latch 50, and FIG. 8 is an exploded perspective view of the latch 50 and its related parts. Herein, the latch 50 is constituted by a body 51 and a back cover 52, which is detachably attached to the backside of the body 51.

The body 51 of the latch 50 is produced by die casting using an aluminum alloy and the like, wherein in a manner similar to the latch 20, the body 51 of the latch 50 is formed roughly in a semi-cylindrical shape whose rear side is opened and is constituted by a main portion 51 A through which the bolt 9 penetrates and a latch portion 51B that is hooked on the clamp frame 5. Through holes 26 and 27 are formed at different positions of the main portion 51 A to allow the shaft portion 9A of the bolt 9 to penetrate therethrough. The shaft portion 9A of the bolt 9 is constituted by a non-thread portion $9A_1$ constructing a base portion thereof and an effective thread portion $9A_2$ constructing a tip end portion thereof, which may be clearly separated in appearance via a boundary corresponding to an imperfect thread portion $9A_3$ therebetween.

The back cover 52 is made of a synthetic resin and is constituted by a cover board 52A and a bent portion 52B that is bent from the upper end of the cover board 52A, so that the back cover 52 as a whole is formed like a reverse L-shape in side view. The cover board 52A is formed in a prescribed shape roughly identical to the rear shape of the body 51 of the latch 50, wherein an anti-extraction member 53 projects at a front side and is integrally formed together with the cover board 52A. The anti-extraction member 53 has a roughly rectangular shape that projects perpendicular to the surface of the cover board 52A, wherein an anti-extraction hole 55 is formed at approximately the center of the anti-extraction member 53. Herein, the non-thread portion $9A_1$ of the bolt 9 loosely engages with the anti-extraction hole 55 in such a way that the non-thread portion $9A_1$ can rotate freely and move in an axial direction of the bolt 9. Specifically, the anti-extraction hole 55 roughly has a rectangular shape whose short length $L_1$ is slightly shorter than an outer diameter D of the non-thread portion $9A_1$ of the bolt 9 and whose long length $L_2$ is slightly larger than the outer diameter D of the non-thread portion $9A_1$ of the bolt 9.

A pair of guides 56 integrally project from the surface of the cover board 52A of the back cover 52 above both ends of the anti-extraction member 53 in order to guide the bolt 9 to be inserted into the anti-extraction hole 55. In addition, a receiving member 58 integrally projects from the surface of the cover board 52A and is arranged below the anti-extraction member 53 by a prescribed distance therebetween, wherein the receiving member 58 has a circular hole 57 to receive the bolt 9 therein and to regulate horizontal movement of the bolt 9.

The rear side of the latch 50 is covered with the back cover 52 in such a way that the cover board 52A is brought into tight contact with the rear opening of the main portion 51A of the body 51 of the latch 50 to be closed, while the bent portion 52B is brought in engagement with the lower portion of the latch portion 51B, so that the back cover 52 is detachably attached to the body 51 of the latch 50. Thus, both the anti-extraction hole 55 and the circular hole 57, which are vertically distant from each other, match the axial line of the through holes 26 and 27 forming a passage inside of the body 51 of the latch 50 therethrough, so that the shaft portion 9A of the bolt 9 can be inserted through the body 51 of the latch 50 via a washer 59. When the shaft portion 9A of the bolt 9 is inserted into the anti-extraction hole 55, the human operator presses the bolt 9 so that the non-thread portion $9A_1$ is located in the anti-extraction hole 55. Herein, the anti-extraction member 53 is made of a synthetic resin similarly to the back cover 52. Therefore, when the bolt is pressed to be inserted into the anti-extraction hole 55, the anti-extraction hole 55 is deformed due to elasticity thereof, which allows the bolt 9 to be safely inserted therein under pressure.

The latch 50 having the aforementioned structure is designed in such a way that the anti-extraction member 53 is integrally formed together with the cover board 52A of the back cover 52. Therefore, it is possible to reduce the total number of parts required for a drumhead stretching mechanism for a drum.

In addition, the anti-extraction member 53 allows the bolt 9 to be loosely engaged with the anti-extraction hole 55 in such a way that the non-thread portion $9A_1$ can rotate freely and move in an axial direction of the bolt 9. Therefore, even when the bolt 9 is taken off from the lug nut 8 (see FIG. 1B) in order to change a drumhead, it is possible to reliably prevent the bolt 9 from being rattled or from being unexpectedly dropped from latch 50. Furthermore, the bolt 9 is firmly fixed and would not be loosened during performance of a drum in progress, it is possible to prevent the drumhead from being unexpectedly changed in tuning.

As described heretofore, this invention has a variety of effects and technical features, which will be described below.

(1) In a drumhead stretching mechanism adapted to a drum in accordance with this invention, an anti-extraction member for preventing a bolt for tightening a drumhead from being extracted is equipped in a latch; therefore, it is possible to prevent the bolt from falling off, from unnecessarily rotating, from floating in an axial direction, and from becoming loose.

(2) The anti-extraction member is formed in a U-shape or a C-shape, which engages with a non-thread portion of the bolt in a direction perpendicular to the axial direction of the bolt. That is, it is possible to attach the anti-extraction member and detach it from the bolt with ease. Due to elasticity of the U-shaped (or C-shape) anti-extraction member in its diameter direction, the bolt would not easily fall off once engaged with the anti-extraction member.

(3) Since the latch and the anti-extraction member can be integrally interconnected together, it is possible to reduce the total number of parts required for the drumhead stretching mechanism.

(4) The non-thread portion of the bolt is engaged with the anti-extraction member in such a way that it can rotate freely and it can be moved in the axial direction of the bolt. Therefore, it is possible to reliably prevent the bolt from rattling or from falling off from the latch when replacing a drumhead with a new one. Furthermore, it is possible to prevent the drumhead from being unexpectedly changed in tuning because the bolt will not become loose during the progress of a performance of a drum.

As this invention may be embodied in several forms without departing from the spirit or essential characteristics thereof, the present embodiments are therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. A drumhead stretching mechanism adapted to a drum, comprising:

a lug nut that is arranged in an outer periphery of a hollow cylinder of a drum;

a clamp frame for clamping a drumhead stretched at ends of the hollow cylinder of the drum;

a latch that is hooked on the clamp frame;

a bolt that interconnects together the latch and the lug nut, which are arranged apart from each other with a prescribed distance therebetween along the outer periphery of the hollow cylinder of the drum; and an anti-extraction member arranged inside of the latch, for preventing the bolt from being extracted from the latch when the bolt engages with the anti-extraction member.

2. A drumhead stretching mechanism according to claim 1, wherein the anti-extraction member is interlocked with an anti-rotation member in the latch.

3. A drumhead stretching mechanism according to claim 1, wherein the anti-extraction member is formed in a U-shape or a C-shape having a circular hole substantially matching a diameter of the bolt and an opening that is slightly smaller than the diameter of the bolt.

4. A drumhead stretching mechanism according to claim 3, wherein the anti-extraction member is made of an elastic material.

5. A drumhead stretching mechanism according to claim 3, wherein the anti-extraction member is stored in a hollow space that is formed inside of the latch and whose back wall comes in contact with terminal ends of the anti-extraction member to avoid rotation of the anti-extraction member within the hollow space.

6. A drumhead stretching mechanism according to claim 1, wherein the anti-extraction member is made of an elastic material.

7. A drumhead stretching mechanism according to claim 1, wherein the latch and the anti-extraction member are integrally interconnected together.

8. A drumhead stretching mechanism according to claim 7, wherein the anti-extraction member has an anti-extraction hole having a rectangular shape whose short length is slightly less than a diameter of a non-thread portion of the bolt and whose long length is slightly greater than the diameter of the non-thread portion of the bolt.

9. A drumhead stretching mechanism according to claim 1, wherein the anti-extraction member has an anti-extraction hole having a rectangular shape whose short length is slightly less than a diameter of a non-thread portion of the bolt and whose long length is slightly greater than the diameter of the non-thread portion of the bolt.

* * * * *